United States Patent [19]

Harada et al.

[11] Patent Number: 4,786,854

[45] Date of Patent: Nov. 22, 1988

[54] ALTERNATING CURRENT VOLTAGE REGULATOR USING A FEEDBACK LOOP WITH STEP FILTERING

[75] Inventors: Kosuke Harada; Takazi Nakamizo; Cheng-Jen Chen, all of Fukuoka, Japan

[73] Assignee: Nishimu Electronics Industries, Co., Ltd., Fukuoka, Japan

[21] Appl. No.: 100,487

[22] Filed: Sep. 24, 1987

[30] Foreign Application Priority Data

Oct. 17, 1986 [JP] Japan ..... 61-245346
May 21, 1987 [JP] Japan ..... 62-124423

[51] Int. Cl.[4] ..... G05F 1/12

[52] U.S. Cl. ..... 323/232; 323/248; 323/280

[58] Field of Search ..... 323/232, 247, 248, 251–253, 323/306, 310, 280; 363/75, 90

[56] References Cited

U.S. PATENT DOCUMENTS

| | | | |
|---|---|---|---|
| 3,122,699 | 2/1964 | Schonan | 323/232 |
| 3,129,381 | 4/1964 | Manteuffel | 323/248 |
| 4,439,722 | 3/1984 | Budnick | 323/248 |
| 4,441,070 | 4/1984 | Davies et al. | 323/280 |
| 4,656,412 | 4/1987 | McLyman | 323/306 |

FOREIGN PATENT DOCUMENTS

| | | | |
|---|---|---|---|
| 135446 | 11/1978 | Japan | 323/280 |

OTHER PUBLICATIONS

Hyland, "Constant Current Circuit," IBM Tech. Discl. Bul., vol. 13, No. 8, pp. 2367, 2368, Jan. 1971.

Tang, "Discrete Regulator Design Regulates Close to Supply Bus," Electronic Design, vol. 28, No. 16, p. 102, Aug. 2, 1980.

*Primary Examiner*—William H. Beha, Jr.

*Attorney, Agent, or Firm*—Kinney & Lange

[57] ABSTRACT

An AC voltage regulator includes an output voltage sensing and regulating device having a suitable filter characteristic to attenuate AC components therein occurring in the frequency ranges corresponding to the almost periodic oscillations or abnormal oscillations, or high frequency components of distorted waves which appear in the AC output voltage and are causes for such abnormal oscillations. The AC voltage regulator does not need to use a dummy load to suppress almost periodic oscillations even when the load is extremely small. The output voltage of the AC voltage regulator is free from abnormal oscillation components such as almost periodic oscillations and low frequency oscillations.

11 Claims, 5 Drawing Sheets

ALTERNATING CURRENT VOLTAGE REGULATOR USING A FEEDBACK LOOP WITH STEP FILTERING

BACKGROUND OF THE INVENTION

1. Field of the Invention

This invention relates to an alternating current (hereinafter referred to as "AC") voltage regulator, and more particularly to an AC voltage regulator which permits generation of a stable output voltage free from abnormal oscillation components such as almost periodic oscillations and low frequency oscillations.

2. Description of the Prior Art

For communication and data processing systems and instrumentation controlling systems, it is important that their power sources should be maintained at substantially constant voltages. To meet the requirement, numerous voltage regulators of varying principles have been developed and adopted for actual use.

FIG. 2 is a block diagram illustrating one conventional AC voltage regulator.

A resonant capacitor 3 and a reactor 2 are connected in series to an input (commercial) power source 1. Preferably, the reactor 2 and the capacitor 3 have values such as to be in the state of series resonance relative to the power source frequency. A load 10 is connected in parallel with the capacitor 3. A series circuit interconnecting a linear reactor 4 and a switching circuit 7 (such as, for example, a triac or two thyristors bidirectionally connected in parallel) is connected in parallel with the resonant capacitor 3. An output voltage sensing and regulating device 9 is connected in parallel with the load 10 and provides the switching element 7 with an ON-OFF control signal depending on the output (load) voltage.

To be specific, the equivalent reactance of the linear reactor 4 is variably regulated by regulating the firing angle of the switching circuit 7 in accordance with the output signal from the output voltage sensing and regulating device 9.

More specifically, this variable regulation is effected by comparing the load voltage $E_0$ with the target value and, when the load voltage is higher than the target value, the firing phase angle is advanced according to the difference of the load voltage from the target value so as to increase the current flowing to the linear reactor 4 and lower the output voltage $E_0$ being applied to the load 10. When the load voltage $E_0$ is lower than the target value, the variable regulation is effected in the reverse manner.

The constant voltage power source system of FIG. 2 has been finding rapidly growing utility in practical applications because it is held in high esteem for various advantages such as absence of dependency on frequency, less distortion of waveform, and high operational efficiency.

Systems illustrated in FIG. 3 and FIG. 4 which are based on the same operating principle as the AC voltage regulator of FIG. 2 have also been known to the art.

In the system of FIG. 3, the power source side and the load side are interconnected through the medium of a transformer 11 and, in the place of the tuning capacitor 3 of FIG. 2, tuning circuits C3, L3 and C5, L5 for the third harmonic component and the fifth harmonic component are interconnected.

In the system of FIG. 4, the power source side and the load side are interconnected through the medium of a transformer 12 provided with a magnetic shunt and the linear reactor 2 of FIG. 2 is omitted.

Since the circuits for these systems are basically similar to the circuit of the system of FIG. 2, any further description of these circuits is omitted herein.

Since the various systems based on the conventional technique described above inevitably have nonlinearities in their respective circuits, their output voltages can be expected to contain high-frequency oscillation components other than the power source frequency. To be specific, when the equivalent mean inductance of the linear reactor 4 is regulated by on-off controlling the current flowing through the linear reactor 4 by the switching element 7, the current through the linear reactor 4 is caused to assume a distorted waveform to give rise to high frequency components. Further those high frequency components are subject to variation in magnitude due to voltage regulation.

When the load current is large, such high frequency oscillation is repressed by the losses in the load and consequently converted into a feeble oscillation to be synchronized with the power source (fundamental) frequency. Thus, the high frequency oscillation is prevented from manifesting itself in the output voltage. When the load current is particularly light, the high frequency oscillation cannot be synchronized and so oscillations of various frequency components arise and the resultant beat oscillations interfere with one another in a complicated manner and manifest themselves in the output voltage as abnormal oscillations such as almost periodic oscillations or low frequency oscillations.

This phenomenon is the gravest drawback in implementation of a voltage regulator. For prevention of this phenomenon, when the load current is low, the practice of putting a dummy resistance across the load and consequently suppressing the adverse effect of an extremely light load current mentioned above is resorted to.

In this case, the dummy load inevitably, as a result, entails an excess loss and lowers the overall efficiency of the system as a whole. Moreover, since the dummy load entails generation of heat, the system must be provided with a large radiator for release of the heat from the system. Thus, this practice has the disadvantage that the system becomes large and expensive.

SUMMARY OF THE INVENTION

An object of this invention is to eliminate the disadvantages mentioned above and provide an AC voltage regulator which is incapable of generating almost periodic oscillation even when the load current is extremely low. This invention is characterized by the AC voltage regulator, without requiring use of any dummy resistance, being enabled to stabilize the output thereof by providing a suitable filter characteristic in an output voltage sensing and regulating device used therein and consequently providing this device with an attenuation characteristic in the frequency ranges corresponding to almost periodic oscillations or abnormal oscillations or at the high-frequency components of distorted waves which are causes for the abnormal oscillations mentioned above.

DETAILED DESCRIPTION OF THE PREFERRED EMBODIMENTS

Now, the present invention will be described in detail below with reference to the accompanying drawings.

Figure 1:
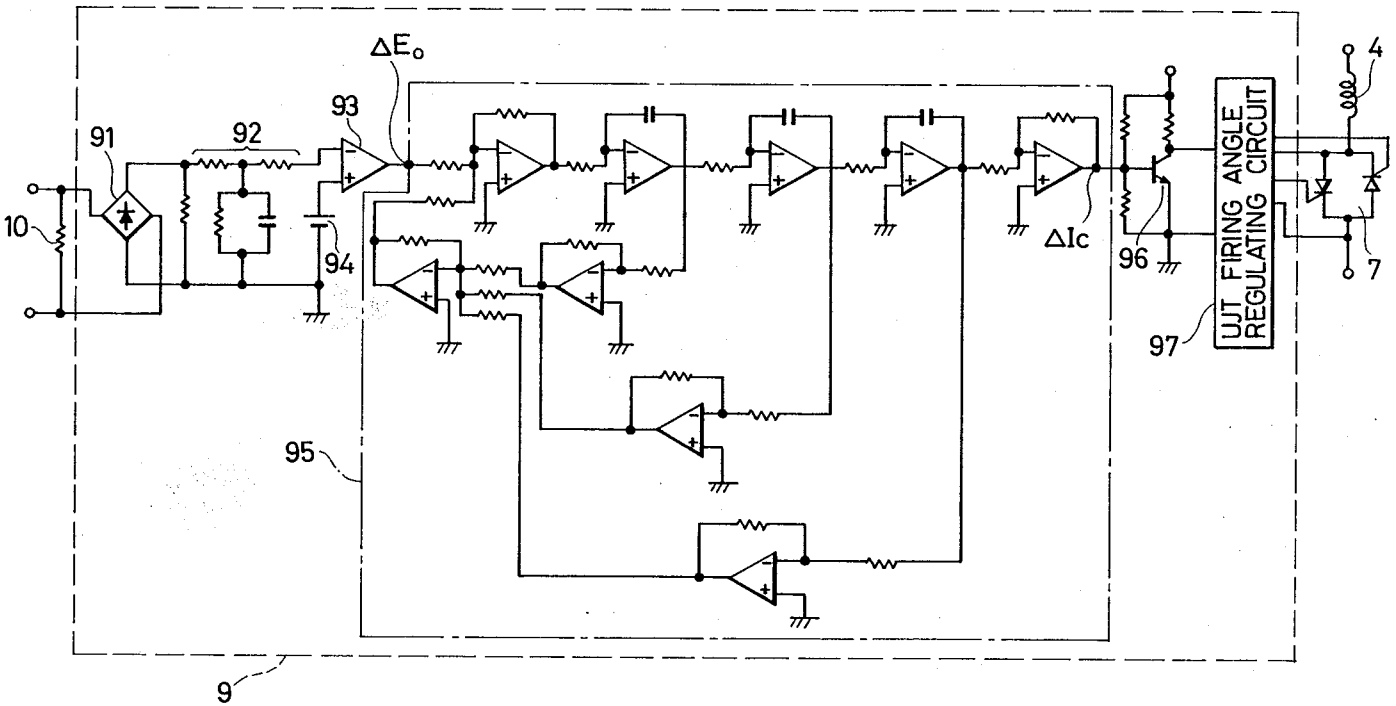
FIG. 1 is a circuit diagram illustrating the configuration of an essential part of a typical AC voltage regulator as one embodiment of this invention.

FIG. 1 is a circuit diagram illustrating the configuration of an output voltage sensing and regulating device, which is an essential component of a typical AC voltage regulator as one embodiment of the present invention.

Figure 2:
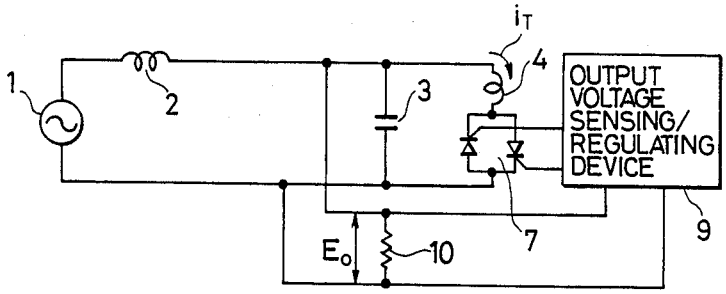
FIG. 2 PRIOR ART
FIG. 2 is a block diagram illustrating a typical conventional AC voltage regulator.

In this diagram, the same reference numerals as used in FIG. 2 denote identical or equivalent parts.

Figure 3:
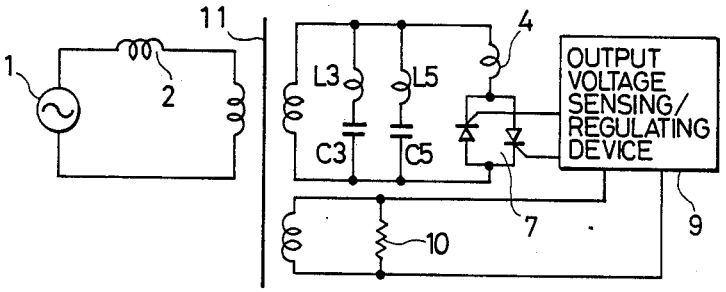
FIG. 3 PRIOR ART
FIG. 3 and FIG. 4 are circuit diagrams illustrating other typical conventional AC voltage regulators.
Figure 4:
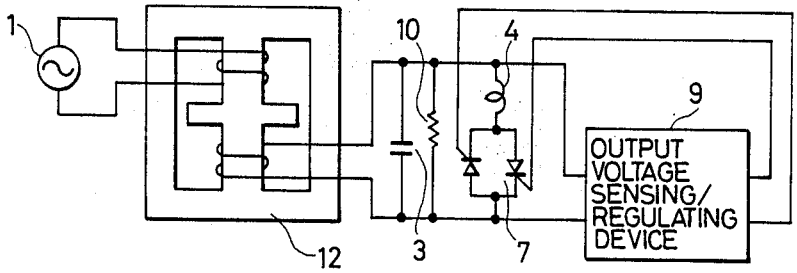
FIG. 4 PRIOR ART

The output sensing and regulating device can be used as incorporated in the conventional voltage regulators of FIGS. 2 through 4.

A regulator output alternating voltage generated across load 10 is converted by a rectifier 91 and a smoothing circuit 92 into a direct current (hereinafter referred to as "DC") signal. The DC signal thus obtained is compared in a comparator 93 with a target selected voltage signal 94 to find a deviation $\Delta E_0$. This deviation $\Delta E_0$ is fed to a filter circuit 95.

The filter circuit 95 illustrated in FIG. 1 is a third order active filter composed of a plurality of operational amplifiers (the basic operation of the active filter is described as in "INTEGRATED ELECTRONICS, Analog and Digital Circuit and Systems," pp. 548–559, written by Millman Halkias and published by McGRAW-HILL KOGAKUSHA and well known in the art and, therefore, not described herein) and serves to attenuate the abnormal oscillation components contained in the deviation $\Delta E_0$.

In this case, there is a desire to avoid attenuating the power source fundamental frequency component to the fullest possible extent and, therefore, the attenuation in this filter of the abnormal oscillation component is required at least to be larger than that of the power source frequency component. The order of the filter mentioned above need not necessarily be third The filter may be of a higher order, but can also be second order. It is also effective to provide the filter a peak characteristic in the neighborhood of the power source frequency. Owing to this peak characteristic, the high frequency components of the distorted wave are repressed and the level of beat oscillation is decreased.

The output $\Delta Ic$ of the filter circuit 95 is amplified by a transistor 96 and this amplified output is supplied to a UJT (unijunction transistor) firing angle regulating circuit 97 which controls a switching circuit 7 in such a way that the firing angle of the switching circuit 7 will be advanced and the mean current flowing to the linear reactor 4 will be increased in proportion as the magnitude of this difference increases when the deviation $\Delta E_0$ is positive.

The UJT firing angle regulating circuit 97 can be easily realized, for example, by using a "UJT relaxation oscillator" circuit as described in "SCR Handbook," p. 82, published by Maruzen Co., Ltd. on Nov. 30, 1966. Of course, it is permissible to use a suitable firing angle regulating circuit which is not based on the UJT.

The filter circuit above has been described as using an active filter incorporating therein an operational amplifier as a filter circuit. As is evident to persons skilled in the art, a filter possessing a similar characteristic can be configured by using, in the place of the active filter, the combination of an L-C circuit, or an R-C circuit, and an amplifier and further using a digital circuit. In the configuration of FIG. 1, the filter circuit 95 may be inserted at the input of comparator 93 rather than at the output.

Further, a magnetic amplifier may be used in the place of the filter circuit 95 by utilizing such a fact that the magnetic amplifier possesses a filter characteristic.

Figure 5:
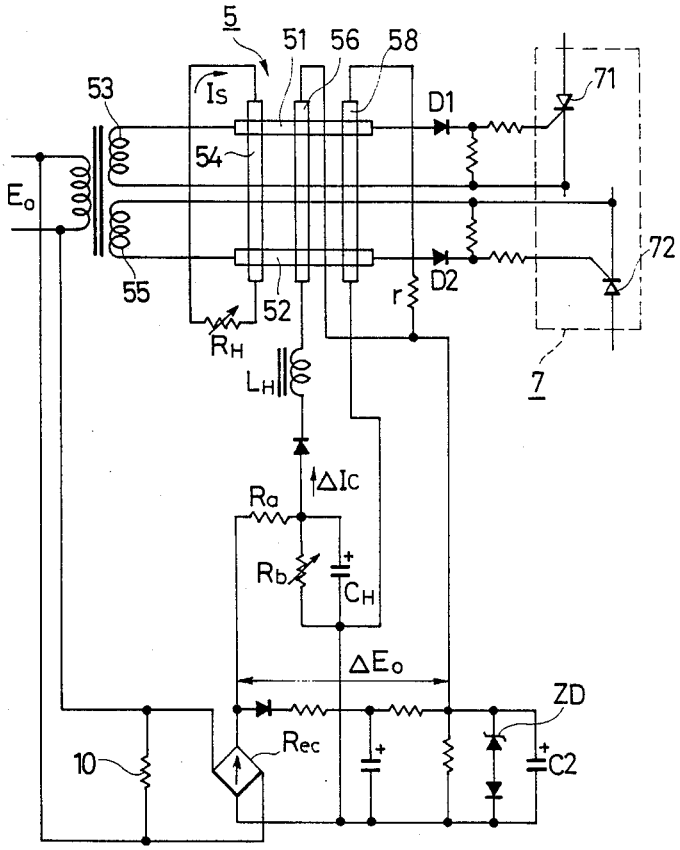
FIG. 5 is a circuit diagram illustrating the configuration of an essential part of an AC voltage regulator of this invention using a magnetic amplifier as a filter circuit.

FIG. 5 is a circuit diagram illustrating the configuration of an essential part of the AC voltage regulator of this invention using a magnetic amplifier.

The magnetic amplifier 5 is composed of first and second gate windings 51, 52 wound separately on a pair of cores (not shown), a short-circuit winding 54, a control winding 56, and a bias winding 58 wound commonly on the cores. The input sides of the first and second gate windings 51, 52 are connected to output voltage $E_0$ through the medium of a transformer at respective transformer secondary windings 53 and 55, and the output sides thereof are respectively connected to the gate and the cathode of thyristors 71 and 72, through the medium of diodes D1 and D2, these thyristers being bidirectionally connected in parallel.

The short-circuit winding 54 is short-circuited with a resistor $R_H$. The output voltage $E_0$ produced across load 10 is rectified by rectifier REC and smoothed, the resultant DC output being fed to a Zener diode ZD. A capacitor C2 connected in parallel with Zener diode ZD. The Zener diode ZD provides a selected target voltage signal corresponding to the Zener voltage and a deviation voltage, $\Delta E_0$, is generated between the positive side output terminal of rectifier Rec and the positive terminal of the capacitor C2.

A linear reactor $L_H$ and resistor Ra are connected in series to the control winding 56. The deviation voltage $\Delta E_0$ is applied across this series circuit. A bias winding 58 is connected via a resistor r across the opposite terminals of the capacitor C2. Further, a parallel circuit of a variable resistor Rb and the capacitor $C_H$ is connected between the connection point of the resistor Ra and the linear reactor $L_H$ and the negative side output terminal of the rectifier Rec.

The magnetic amplifier, as widely known, is an active circuit the output of which is varied by the amount of the magnetic flux to be reset. In the embodiment of FIG. 5, the amount of the magnetic flux to be reset is determined by the deviation voltage $\Delta E_0$. The circuit elements $L_H$, $R_H$, and $C_H$ mentioned above function to provide adjustable filter characteristics with respect to the change in the amount of the magnetic flux of the magnetic amplifier to be reset in consequence of the change in the deviation voltage $\Delta E_0$.

Figure 6:
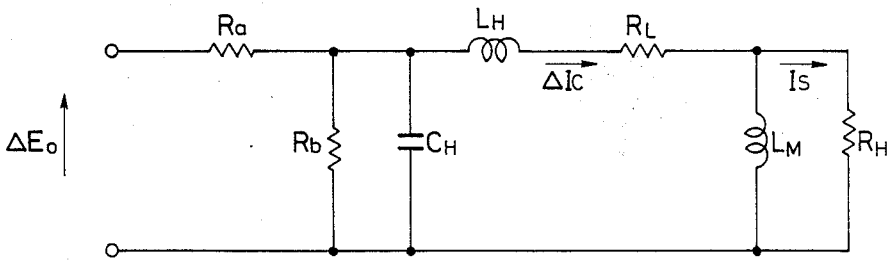
FIG. 6 is an equivalent circuit diagram for illustration of the transient response of the magnetic amplifier shown in FIG. 5.

FIG. 6 is an equivalent circuit diagram for illustrating the transient response of the magnetic amplifier illustrated in FIG. 5. In this diagram, the same reference numerals as used in FIG. 5 denote identical or equivalent parts.

In the circuit diagram, $R_L$ stands for internal resistance of the linear reactor $L_H$, $L_M$ for an equivalent inductance of the magnetic amplifier Is for a current flowing in the short-circuit winding 54, and ΔIc for a current flowing in the control winding 56. In this arrangement, therefore, the control magnetomotive force of the magnetic amplifier is fixed by the magnitude of the current (ΔIc−Is) flowing in the equivalent inductance $L_M$.

As clearly noted from FIG. 6, the transfer function for the transient response of the magnetic amplifier is expressed as follows:

$$(66\ Ic-Is)/\Delta E_0=A/(S^3+BS^2+CS+D)$$

where, $$A=RbR_H/RaRbL_HC_HL_M,$$

$$B=\{RaRbC_HL_MR_H+RaRbL_HC_HR_H+RaRbR_L\cdot C_HL_M+(Ra+Rb)L_HL_M\}/RaRbL_HC_HL_M,$$

$$C=[RaRbR_LC_HR_H+(Ra+Rb)R_HL_M+\{(Ra+Rb)R_L+RaRb)L_M+L_H(Ra+Rb)R_H]/RaRbL_HC_HL_M,$$

$$D=[R_L(Ra+Rb)+RaRb]R_H/RaRbL_HC_HL_M, \text{ and}$$

S is the Laplace variable.

From the analysis given above, it is noted that the magnetic amplifier of FIG. 5 functions as a filter, that the characteristic of this magnetic amplifier corresponds to that of the filter circuit 95 illustrated in FIG. 1 in being of third order, and that this filter characteristic can be suitably adjusted by varying at least one of the factors $L_H$, $R_H$, and $C_H$.

For example, the frequency range in which the ratio of attentuation is increased can be shifted to the lower range side by decreasing the series resistance $R_H$ connected with the short-circuit winding 54 and increasing the capacitor $C_H$ and the inductance $L_H$ connected with the control winding 56.

When the magnetic amplifier is adopted as a filter, therefore, a selected design and its fine adjustment, of the filter characteristic can be implemented for actual use in the circuit with great ease. Moreover, the magnetic amplifier by its nature is a filter of relatively high order. Since it is composed mainly of iron cores and copper wires, the magnetic amplifier features a strong mechanical structure, a high operational reliability, a ready insulation of signals and a sparing occurrence of internal noise and, further it inhibits entry of noise from the power source line. Owing further to its operating principle, the magnetic amplifier functions to offer protection from overload.

Figure 7:
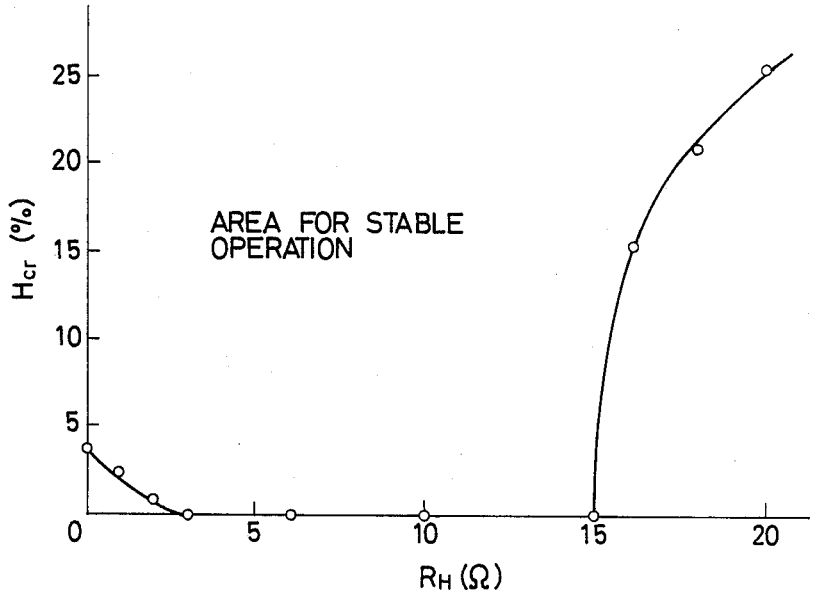
FIG. 7 is a graph showing the relation between the resistance, $R_H$, and the marginal rate of minimum loading, $H_{cr}$, obtained in the AC voltage regulator of FIG. 5.

FIG. 7 shows the results of an actual test performed on a AC voltage regulator using as an output voltage sensing and regulating device the magnetic amplifier of FIGS. 5 and 6 to determine, as a dependent variable, the marginal rate of minimum loading, Hcr, at which the regulator can operate without giving rise to abnormal oscillations such as almost periodic oscillation. These results were obtained with $C_H$ fixed at 47 μF and $L_H$ at 1.2H and with the resistance, $R_H$, as an independent variable. The marginal rate of minimum loading, $H_{cr}$ (%), as used herein is defined by the following formula:

$$H_{cr}=\frac{\text{minimum output power for stable operation}}{\text{power of 100\% load}}\times 100\ (\%)$$

when the power source frequency is fixed at 50 Hz and the output voltage, $E_0$, at a load of 50% is 231 V.

From FIG. 7, it is clearly noted that throughout a certain range of resistance, $R_H$, (3 to 15Ω), there exists a region in which absolutely no abnormal oscillation occurs even in the state of no load ($H_{cr}=0$) and that the present embodiment realizes complete stability of operation. It has been ascertained by the inventors that the same test results are obtained by selecting the condenser $C_H$ or the reactance $L_H$ as an independent variable in the place of the resistance, $R_H$.

Figure 8:
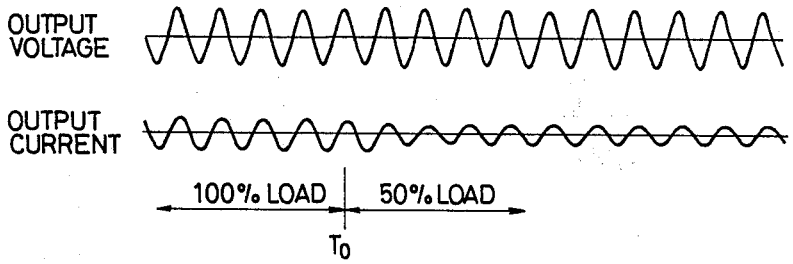
FIG. 8 is a time chart illustrating the transient phenomenon of output voltage/current changes due to sudden change of the load from 100% to 50% under the same conditions as those of FIG. 7.

FIG. 8 is a time chart illustrating the transient phenomenon of the change of output voltage due to sudden change of load from 100% to 50% at the time, $T_0$, determined under the same conditions as those of FIG. 7.

It is noted from FIG. 8 that even when the abnormal oscillations such as almost periodic oscillation included in the output voltage are repressed by the insertion of a filter in the control circuit as in the present embodiment, there is obtained substantially the same transient response as in the control by the conventional method without entailing such inconveniences as increase of overshoot.

Figure 9:
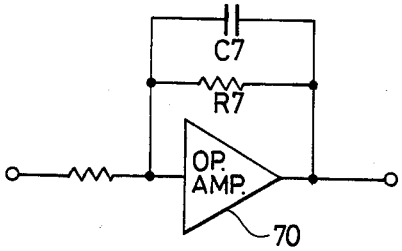
FIG. 9 is a diagram illustrating another suitable filter circuit for the purpose of this invention.

FIG. 9 illustrates another typical filter circuit suitable for the present invention. This filter circuit can be used in the place of the filter 95 in the regulator of FIG. 1. As illustrated, this filter circuit is composed of an operational amplifier 70 with a resistor R7 and a capacitor C7 connected in parallel between the input and output terminals of the operational amplifier 70. It functions as a low pass filter for reducing high frequency components exceeding the power source frequency. When filter circuits, each of which is configured as illustrated in FIG. 9, are serially connected, the arrangement consequently obtained proves to be advantageous. This is because such an arrangement enables the gain-frequency characteristic of the low pass filter to be sharply attenuated at a cut-off frequency fixed at a slightly higher frequency than the power source frequency or the fundamental frequency.

Figure 10:
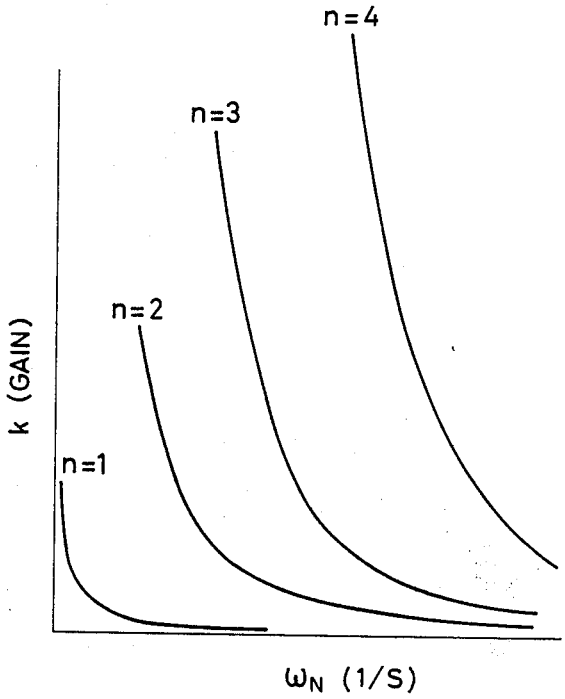
FIG. 10 is a diagram illustrating the region in which the AC voltage regulator of the present invention is stably operated.

FIG. 10 shows the region of stable operation of the voltage regulator on the frequency-gain characteristic, with the horizontal axis as the scale of the cut-off frequency, $\omega_N$, and the vertical axis as the scale of gain, k, and with the number of stages, n, of the low pass filters used as a parameter. In this diagram, of the two regions demarcated by each of the curves, the region falling on the origin side represents a region of stable operation and the region on the opposite side a region of unstable operation. From this diagram, it is noted clearly that the region of stable operation gains in area in proportion as the number of filter steps increases. As evident from the foregoing description of the invention, by the use of such an output voltage sensing and regulating device as illustrated in FIG. 1 or FIG. 5, abnormal oscillations such as almost periodic oscillations which may appear during the presence of a light current load upon the AC voltage regulator can be thoroughly suppressed without necessitating use of a dummy resistance and the stabilization of the output voltage can be realized to a greater extent.

What is claimed is:

1. An alternating current (AC) voltage regulator comprising:

a first linear reactor and a capacitor adapted for being connected in series to an alternating current power source of a selected frequency and which together are in a state of substantial resonance relative to the selected frequency, a series circuit formed of a second linear reactor and a bi-direction switching element, and connected to said capacitor in parallel therewith, means for sensing a deviation of the output voltage generated across the capacitor from a selected value, means for regulating said bi-direction switching element in accordance with said deviation in such a manner as to advance the firing angle of said switching element in proportion to said deviation increases when said deviation has a positive value, and filter means having a filter characteristic for steeply attenuating abnormal oscillation frequency components contained in said deviation differing in frequency from the selected frequency such that this steep attenuation is the result of the filter characteristic being of at least second order.

2. The AC voltage regulator according to claim 1, wherein said filter means is interposed between an output terminal of said means for sensing said deviation and an input terminal of said means for regulating said bi-direction switching element.

3. The AC voltage regulator according to claim 1, wherein said filter means comprises at least one active filter circuit.

4. The AC voltage regulator according to claim 1, wherein the filter characteristic of said filter means is selected so that the rate of attenuation in regions of abnormal oscillation frequency will be larger than that in the region of the selected frequency.

5. The AC voltage regulator according to claim 1, wherein the filter characteristic of said filter means is selected so that the rate of attenuation in regions of frequency higher than the selected frequency will be larger than that in the region of the selected frequency.

6. The AC voltage regulator according to claim 1, wherein said filter means is a band pass filter possessing a filter characteristic with a pass band therein in the region of the selected frequency.

7. An alternating current voltage regulator, comprising:

a first linear reactor and a capacitor adapted to be connected in series to an alternating current power source of a selected frequency and which together are in the state of substantial resonance relative to the selected frequency, a series circuit formed of a second linear reactor and a bi-direction switching element, and connected to said capacitor in parallel therewith, means for sensing a deviation of the output voltage generated across the capacitor from a selected value, means for regulating said bi-direction switching element in accordance with said deviation in such a manner as to advance the firing angle of said switching element in proportion as said deviation increases when said deviation has a positive value, and a magnetic amplifier as a filter means for attenuating abnormal oscillation frequency components contained in said deviation, wherein the magnetic amplifier has a control winding and a characteristic-setting winding each wound on a common magnetic material core with the characteristic-setting winding formed in a closed circuit loop and the control winding supplied with a current based on said deviation.

8. The AC voltage regulator according to claim 7, wherein said magnetic amplifier as a filter means is interposed between an output terminal of said means for sensing said deviation and an input terminal of said means for regulating said bi-direction switching element.

9. The AC voltage regulator according to claim 7, wherein said magnetic amplifier as a filter means includes a means for adjusing the filter characteristic by controlling the change in the amount of the resetting magnetic flux produced by said deviation voltage that is a variable resistor connected in series with the characteristic-setting winding of the magnetic amplifier.

10. The AC voltage regulator according to claim 7, wherein a reactive circuit component is connected in series with the control winding.

11. The AC voltage regulator according to claim 10, wherein a capacitive circuit component is connected in parallel across the reactive circuit component and the control winding.

12. An alternating current voltage regulator comprising:

a first linear reactor and a first capacitor adapted to be connected in series to an alternating current power source of a selected frequency and which together are in a state of substantial resonance relative to the selected frequency;

a series circuit formed of a second linear reactor and a bi-direction switching element connected in parallel with said capacitor;

means for sensing a deviation of the output voltage generated across the capacitor from a selected value;

means for regulating said bi-direction switching element in accordance with said deviation in such a manner as to advance the firing angle of said switching element in proportion as said deviation increases for said deviation having a positive value; and a magnetic amplifier as a filter means for attenuating abnormal oscillation frequency components contained in said deviation, wherein said magnetic amplifier is composed of first and second gate windings wound separately on a pair of magnetic material cores, with a characteristic-setting winding, a control winding and a bias winding commonly wound on the cores; input terminals of the first and second gate windings being connected to receive a voltage based on said output voltage and output terminals thereof being connected to at least one control terminal of the switching element; the characteristic-setting winding being in a closed loop with a first resistor thereacross; the control winding having a third linear reactor and a second resistor connected in series therewith serving as said means for sensing said deviation which deviation is applied across the series circuit of the third linear reactor and the second resistor and the control winding; there being a parallel circuit of a variable resistor and a second capacitor connected between a terminal means on which a reference voltage is established upon occurrence of an output voltage and the junction of the second resistor and the third linear reactor.

* * * * *